United States Patent [19]

Koski et al.

[11] Patent Number: 4,921,584

[45] Date of Patent: May 1, 1990

[54] ANODE FILM FORMATION AND CONTROL

[75] Inventors: Oscar Koski; Steven C. Marschman, both of Richland, Wash.

[73] Assignee: Battelle Memorial Institute, Richland, Wash.

[21] Appl. No.: 116,560

[22] Filed: Nov. 3, 1987

[51] Int. Cl.[5] ..... C25C 3/06

[52] U.S. Cl. ..... 204/67

[58] Field of Search ..... 204/67, 243 R, 243 M

[56] References Cited

U.S. PATENT DOCUMENTS

| | | | |
|---|---|---|---|
| 3,471,390 | 10/1969 | Kibby et al. | 204/67 |
| 3,578,569 | 5/1971 | Lewis | 204/243 R |
| 3,829,374 | 8/1974 | Kugler et al. | 204/290 R |
| 3,960,678 | 6/1976 | Alder | 204/67 |
| 3,974,046 | 8/1976 | Alder | 204/67 |
| 4,057,480 | 11/1977 | Alder | 204/290 R |
| 4,098,651 | 7/1978 | Alder | 204/1 T |
| 4,187,155 | 2/1980 | de Nora et al. | 204/67 |
| 4,288,302 | 9/1981 | de Nora et al. | 204/105 R |
| 4,374,050 | 2/1983 | Ray | 252/519 |
| 4,374,761 | 2/1983 | Ray | 252/519 |
| 4,379,033 | 5/1983 | Clark et al. | 204/67 |
| 4,399,008 | 8/1983 | Ray | 204/67 |
| 4,430,189 | 2/1984 | Clark et al. | 204/290 R |
| 4,455,211 | 6/1984 | Ray et al. | 204/293 |
| 4,462,889 | 7/1984 | Landon et al. | 204/292 |
| 4,478,693 | 10/1984 | Ray | 204/64 R |
| 4,484,997 | 11/1984 | Secrist et al. | 204/243 R |
| 4,504,369 | 3/1985 | Keller | 204/67 |
| 4,529,494 | 7/1985 | Joo' et al. | 204/290 R |
| 4,541,912 | 9/1985 | Secrist et al. | 204/290 R |
| 4,544,457 | 10/1985 | Sane et al. | 204/67 |
| 4,560,448 | 12/1985 | Sane et al. | 204/67 |
| 4,582,585 | 4/1986 | Ray | 204/243 R |
| 4,600,481 | 7/1986 | Sane et al. | 204/67 |
| 4,614,569 | 9/1986 | Duruz et al. | 204/67 |
| 4,620,905 | 11/1986 | Tarcy et al. | 204/64 R |
| 4,639,304 | 1/1987 | Bader et al. | 204/413 |
| 4,680,094 | 7/1987 | Duruz | 204/67 |
| 4,681,671 | 7/1987 | Duruz | 204/67 |
| 4,683,037 | 7/1987 | Duruz | 204/64 R |

*Primary Examiner*—John F. Niebling
*Assistant Examiner*—Kathryn Gorgos
*Attorney, Agent, or Firm*—Wells, St. John & Roberts

[57] ABSTRACT

A protective film is created about the anode within a cryolite-based electrolyte during electrolytic production of aluminum from alumina. The film function to minimize corrosion of the anode by the cryolitic electrolyte and thereby extend the life of the anode. Various operating parameters of the electrolytic process are controlled to maintain the protective film about the anode in a protective state throughout the electrolytic reduction of alumina. Such parameters include electrolyte temperature, electrolyte ratio, current density, and $Al_2O_3$ concentration. An apparatus is also disclosed to enable identification of the onset of anode corrosion due to disruption of the film to provide real time information regarding the state of the film.

16 Claims, 2 Drawing Sheets

FIG. II

ANODE FILM FORMATION AND CONTROL

This invention was made with government support under Contract No. DE-AC06-76RLO 1830 awarded by the U.S. Department of Energy. The government has certain rights in the invention.

TECHNICAL FIELD

This invention relates generally to the Hall-Heroult electrolytic process for manufacture of aluminum. More particularly, the invention relates to anode corrosion in such a process.

BACKGROUND OF THE INVENTION

Hall-Heroult electrolytic cells conventionally employ conductive carbon electrodes. In the Hall-Heroult process, a current is passed between a carbon anode and a carbon cahode in a cryolitic electrolyte containing dissolved alumina. Aluminum metal is reduced from the alumina, and the carbon anode is consumed in the process.

The overall reaction, in its simplest form, is represented as follows:

$$2Al_2O_3 + 3C \xrightarrow[Na_3AlF_6]{940°-1000° C.} 4Al + 3CO_2$$

Approximately 0.33 pounds of carbon are consumed for every pound of aluminum produced, providing a typical useful anode life of two to three weeks.

Aluminum can also be produced by reduction of alumina using the following electrolytic reaction.

$$2Al_2O_3 \rightarrow 4Al + 3O_2$$

The anode liberates oxygen from the alumina, and aluminum metal is produced at the cathode. When employing such a process, anodes constructed of a material other than carbon are used. The anode is not consumed as the chemical composition of the anode does not enter into the electrolysis reaction. Such anodes would theoretically have a life limited only by corrosion due to the cryolite electrolyte and electrochemical degradation mechanisms. It is anticipated that the life of such anodes could be extended to several months or even a year or more as compared to the 2 to 3 week life of a carbon anode which is consumed in the electrolytic reduction reaction. However, most all of these anodes rapidly or catastrophically degrade under normal cell operating conditions.

We have discovered new methods and an apparatus for minimizing corrosion of anodes used in the Hall-Heroult process for production of aluminum.

BRIEF DESCRIPTION OF THE DRAWINGS

Preferred embodiments of the invention are illustrated by the accompanying drawings, in which.

DETAILED DESCRIPTION OF PREFERRED EMBODIMENTS

The following disclosure of the invention is submitted in compliance with the constitutional purpose of the Patent Laws "to promote the progress of science and useful arts" (Article 1, Section 8).

It has been discovered that a protective film can be creaated about the anode within the cryolite-based electrolyte during the reduction process. The film functions to minimize corrosion of the anode by the cryolitic electrolyte and thereby extend the life of the anode. Various operating parameters of the electrolytic process are controlled to maintain the protective film about the anode in a protective condition throughout the electrolytic production of aluminum from alumina to prevent catastrophic degradation of the film and to minimize corrosion of the anode. An apparatus has also been developed to identify the onset of anode corrosion due to disruption of the film.

The film forms regardless of the composition of the anode as well as regardless of whether the anode is consumable. Film formation and maintenance on the anode is of primary importance with non-consumable anodes, e.g. cermets, as the coating functions to protect the anode from being depleted due to corrosion. The reduction reaction which consumes a carbon anode is understood to be significantly favored over the corrosion reaction such that protection of a carbon anode from corrosion is of secondary importance.

Figure 1:
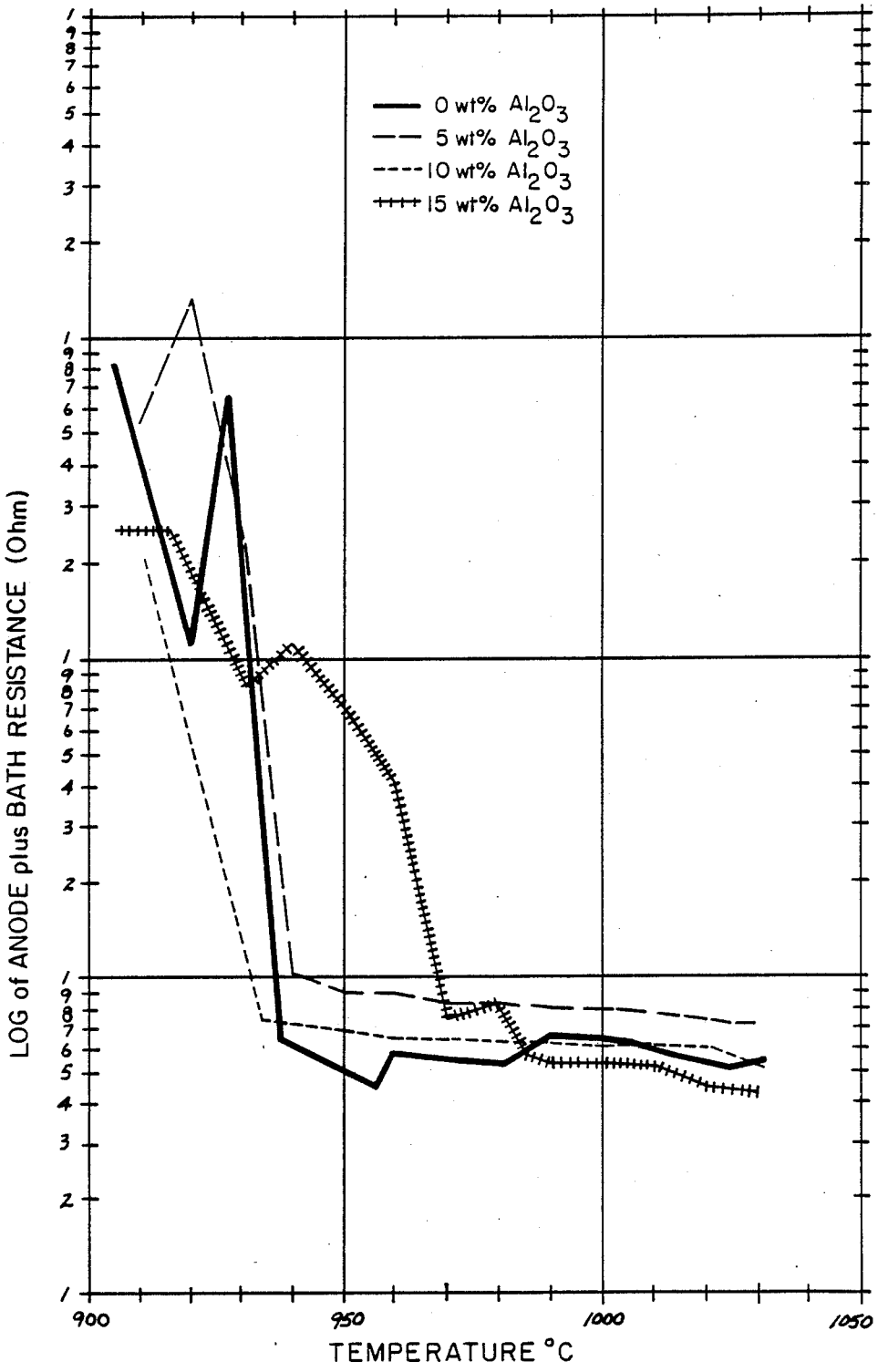
FIG. 1 is a graph of anode/electrolyte (anode/bath) resistance as a function of electrolyte temperature for various $Al_2O_3$ concentrations within a cryolite-based electrolyte.

Creation and maintenance of the protective film is influenced by at least operating temperature, $Al_2O_3$ concentration in the electrolyte, and anode current density for a given electrolyte ratio of NaF to $AlF_3$. FIG. 1 illustrates the effects of temperature on the observed anode and electrolyte resistance for various $Al_2O_3$ concentrations at an electrolyte ratio of 1.1 to 1.0. The values observed are for a laboratory scale Hall-Heroult electrolytic cell employing a cermet anode composition of NiO—$NiFe_2O_4$—Cu—Ni. However, the results obtained as displayed in FIG. 1 are expected to be very similar when using alternate anode compositions. The anode tested was produced by combining 83% oxide powder of NiO—$NiFe_2O_4$ and 17 wt% elemental Cu powder. Ni is reduced from excess NiO in the sintering process which results in Ni also being distributed in the metal phase. The cell was operated at an approximate current density of 0.1 A/cm$^2$ and an approximate voltage of 3 volts for $Al_2O_3$ concentrations ranging from 0 to 15 wt%. FIG. 1 illustrates a marked increase and lack of stability in observed resistance at electrolyte temperatures below approximately 940° C. over $Al_2O_3$ concentrations ranging from 0 to 10 wt%. The same resistance increase and lack of stability are noted at temperatures below approximately 965° C. for an $Al_2O_3$ concentration of 15 wt%.

The observed increase in anode and electrolyte resistance is attributed to the formation of an electrically resistive and protective film layer deposited on or formed about the surface of the anode. This has been determined and is evident as there are no major changes in the resistance of the anode material, leadwire, electrolyte resistance or any other parameters during operation of the cell. At temperatures 940° C. and above for 0 to 10 wt% $Al_2O_3$, and 965° C. and above for 15 wt%

$Al_2O_3$, the resistance of the film drops and stabilizes as evidenced by flattening of the curves.

It has also been discovered that the highly resistive film formed at the lower temperatures is unstable and easily disrupted by $O_2$ nucleation at the anode during the electrolytic process. Greater resistance at lower temperatures is understood to result from a thicker and therefore more electrically resistive film forming about the anode than that formed at higher temperatures. Operation of a cell at lower temperatures results in poor film control and accelerated anode degradation. At these lower temperatures, the film about the anode is cyclic in its presence being repeatingly created and disrupted as the cell operates.

The film formed at higher temperatures of 940° C. and above is stable and not disrupted by bubble nucleation. Accordingly, it is preferable to operate elelctrolytic cells at temperatures above at least approximately 940° C. to enable acceptable operating voltages and anode performance. Below this temperature, the unstable highly resistive film acts as a significant barrier to the passage of electric current resulting in energy waste.

Figure 2:
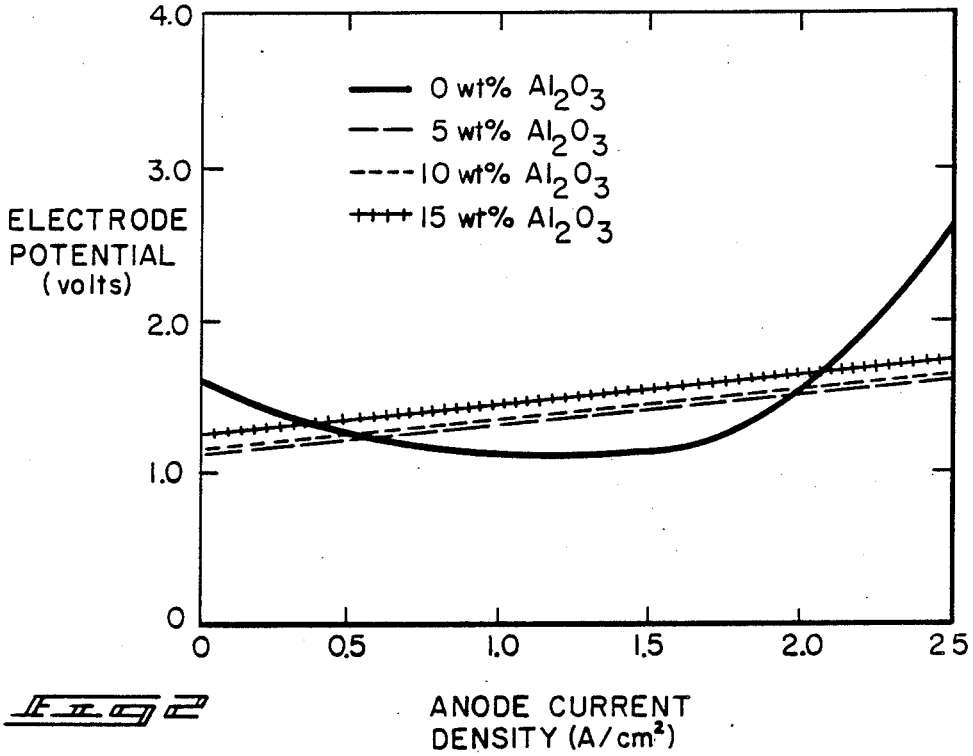
FIG. 2 is a graph of electrode potential as a function of anode current density for various $Al_2O_3$ concentrations within a cryolite-based electrolyte.

FIG. 2 illustrates effects of current density relating to film formation and control. Electrode potential is plotted against anode current density for $Al_2O_3$ concentrations ranging from 0 to 15 wt% in a cell having an electrolyte ratio of 1.1 to 1.0. The electrolysis cell employed an undefined carbon cathode comprised of the graphite walls of the cells. The composition of the anode was the $NiO—NiFe_2O_4—Cu—Ni$ cermet composition described above. The curve illustrated represent the observed cell voltages and the current-resistance corrected electrode potentials (cell voltage minus the current-resistance drop of the cell) as a function of anode current density.

The curve representing zero percent $Al_2O_3$ content illustrates the voltage-current density relationship for the direct electrolytic corrosion reaction of the cryolite-based electrolyte with the $NiO—NiFe_2O_4—Cu—Ni$ cermet anode. The zero percent $Al_2O_3$ curve is expected to be very similar for different anode compositions having similar approximate metal content. As no $Al_2O_3$ is present, no reduction of elemental aluminum takes place, resulting merely in electrolytic corrosion through the protective film that forms. This corrosion reaction is initiated at approximately 1.6 V when no $Al_2O_3$ is present, or about 2.7 V when corrected to a cell referenced against a liquid Al cathode as opposed to a cathode formed by the graphite walls of the cell. The curve for zero percent $Al_2O_3$ indicates that electrode potential decreases with increasing anode current density until approximately 1.6 A/cm$^2$ is reached at which point the electrode potential, and correspondingly electrical resistance, begins to increase significantly. This indicates that the electrolytic corrosion reaction of the anode with the cryolite-base electrolyte is self-catalyzing for anode current densities from 0 to approximately 1.6 A/cm$^2$. The state of the film above this current density range had not been analyzed at the time this application was filed.

The electrode potentials plotted for the three conditions of 5, 10, and 15 wt% $Al_2O_3$ illustrate the electrode potential-anode current denisty relationship where aluminum metal is being reduced by electrolysis. FIG. 2 illustrates that the zero current potentials for the 5, 10, and 15 wt% $Al_2O_3$ electrolytes are approximately 1.1 V, or 0.5 V below the 1.6 V zero current potential for the corrosion reaction. The electrode potentials for the electrolytes containing $Al_2O_3$ remain below that observed for the corrosion reaction up to approximately 0.5 A/cm$^2$ wherein the curves intersect. The film coating the anode has been determined to be stable at 0 A/cm$^2$ to approximately 0.5 A/cm$^2$. Above 0.5 A/cm$^2$ anode current density, the corrosion reaction has a lower potential than the reduction reaction. This indicates that corrosion becomes favored over reduction of aluminum from alumina. The film coating the anode was determined to be generally unstable under these conditions resulting in significant anode failures.

At an anode current denisty of approximately 2.0 A/cm$^2$, the 0 wt% $Al_2O_3$ curve intersects with the 5, 10, and 15 wt% $Al_2O_3$ curves. At anode current densities above 2.0 A/cm$^2$, the corrosion reaction appears to be disfavored as the electrode potentials for reduction of alumina are less than that for the corrosion reaction. However at the time of filing this application, cell operation at anode current densities above 1.25 A/cm$^2$ had not been critically examined over extended periods of time.

It has been determined that at least current density and temperature can be regulated for a given electrolyte ratio to properly maintain a protective film about the anode. The desired operating current density range for the anode is represented by the region above zero current density and below an anode current density where the electrode potentials of the $Al_2O_3$ reduction reactions and corrosion reactions are equally favored. Cells should be operated at a sufficiently high enough temperature (i.e. above approximately 940° C. for 0 to 10 percent $Al_2O_3$, and 956° C. for 15 percent $Al_2O_3$ at an electrolyte ratio of 1.1 to 1.0) to enable development and maintenance of a stable, low-resistance protective film coating about the anode.

Figure 3:
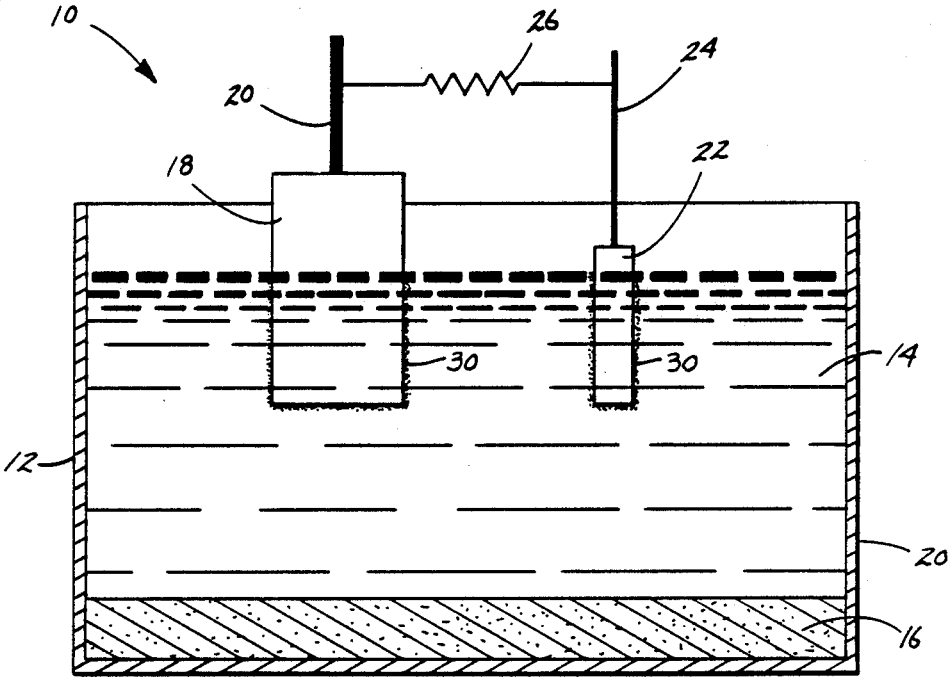
FIG. 3 is a cross-sectional view of an apparatus for electrolytically reducing aluminum from alumina dissolved in a cryolite-based electrolyte in accordance with the invention.

The various optimum operating parameters for creating and maintaining this film are not expected to remain identical with variations in electrolyte chemistry and other elelctrolysis cell parameters which will vary from one reduction facility to another. FIG. 3 illustrates an electrolytic cell and sensor for use in determining stability of the protective film coating about the anode. The cell is indicated generally by reference numeral 10. It includes a receptacle 12 for retaining a solution 14 of alumina dissolved within a cryolite-based electrolyte. A cathode 16 is mounted at the bottom of the receptacle for collecting aluminum. An anode 18 extends into receptacle 12 from its top portion and into solution 14 for liberating aluminum and oxygen from the alumina dissolved in the solution. An electrically conducting rod/support 20 supports anode 18 relative to the receptacle and supplies current thereto.

A sensor 22 is also immersed in electrolyte solution 14 and is supported by an electrically conductive rod/support 24. Sensor 22 is employed for measuring change in voltage, current, or resistance between the anode and electrolyte to monitor the stability of the protective electrical resistive film which forms about the anode during operation of the cell. The sensor is preferably constructed of a material the same as the anode material. Rod/support 24 of sensor 22 is electrically connected to rod/support 20 of anode 18 by means of a resistor circuit 26. The resistor circuit 26 functions to supply a DC current to the sensor which is less than the DC current supplied to the anode. This provides a current density at the sensor whichis a small fraction of that found at the anode, but insures an electrochemical similarity between the anode and sensor. The current density at the sensor should be sufficiently small to prevent a significant potential drop from occurring at the sensor surface. Such a current density preferably approximates 5 $mA/cm^2$. During cell operation, a corrosion protective film 30 will form about both the sensor and anode.

The low current density at the sensor negates any appreciable current-resistance drop across the film which forms about the sensor enabling the potential at the surface of the anode to be monitored. The sensor enables the condition of the protective film formed about the anode to be monitored by measuring change in voltage, current, or resistance between the anode and electrolyte to determine stability of the film. For example, voltage drop over time can be measured between the anode and sensor. This voltage drop is an analog of the voltage drop between the anode and electrolyte across the protective film formed about the anode.

When the coating is being maintained under stable conditions, a steady DC signal over time will be detected between the anode and sensor. Instability of the protective film is easily detected upon the onset of spiking or other variations in the DC signal. With all other operating parameters remaining constant, variation in the DC signal indicates disruption of at least a portion of the anode protective film which could rapidly lead to anode corrosion. Other sensing devices might be used to detect something other than voltage drop to determine film condition, such as perhaps current changes across the film. When film disruption is indicated by an unsteady voltage signal, one of the operating parameters of the cell is adjusted to regenerate and stabilize the film. For example, current density at the anode could be decreased to a point sufficiently below the value where the $Al_2O_3$ reduction reaction, i.e. the liberation of oxygen from aluminum oxyfluoride which is formed by dissolution of $Al_2O_3$, and corrosion reactions are equally favored to regenerate the disrupted portion of the film.

Such a sensing apparatus could be used under aluminum production conditions to provide real time information regarding protective film stability. Alternately, a reduction facility could employ the sensor system to determine the various optimum ranges for the parameters under which the cell is operated. For example, assuming constant $Al_2O_3$ concentration and anode current density, the temperature can be varied until instability sets in. This would enable identification of the upper and lower temperatures at which stable operation of the cell can be maintained. By similar methods, optimum anode current density, $Al_2O_3$ concentration, electrolyte ratios, and other parameters can be identified for any particular electrolyte composition and operating system.

Operation of a cell to prevent corrosion of the anode also would result in improved impurity content of the produced aluminum as contaminates induced into the electrolyte by corrosion of an anode could be significantly reduced or even eliminated.

In compliance with the statute, the invention has been described in language more or less specific as to structural and methodical features. It is to be understood, however, that the invention is not limited to the specific features shown and described, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

We claim:

1. An electrolytic process for producing aluminum, the process including an anode and a cathode suspended in a cryolitic electrolyte containing dissolved alumina, the anode having a working surface through which an effective amount of current flows into the electrolyte and to the cathode, the process comprising:

creating a desired protective film over the total working surface of the anode within the electrolyte during electrolytic reduction of alumina to produce aluminum to minimize corrosion of the working surface of the anode by the cryolitic electrolyte and thereby extend the life of the anode;

reducing the dissolved alumina and producing aluminum metal by passing an effective amount of current through the anode working surface and the protective film into the electrolyte and to the cathode; and controlling operating parameters of the electrolytic process to maintain the desired protective film over the total working surface of the anode intact in a protective condition throughout the elelctrolytic reduction of alumina to produce aluminum.

2. The electrolytic process of claim 1 wherein the film is maintained by regulating current density at the anode.

3. The electrolytic process of claim 2 wherein the film is maintained by decreasing current density at the anode upon initial disruption of the film.

4. The electrolytic process of claim 1 wherein the operating parameters being controlled to maintain the film include at least anode current density and electrolyte temperature.

5. The electrolytic process of claim 4 wherein the operating parameters being controlled to maintain the film include at least $Al_2O_3$ concentration and electrolyte ratio.

6. The electrolytic process of claim 1 wherein the film is maintained by, providing an electrolyte temperature of at least approximately 940° C.; and operating the anode at a current density which favors the reduction of alumina to produce aluminum and liberate oxygen over corrosion of the anode by the cryolitic electrolyte.

7. The electrolytic process of claim 1 wherein the film is maintained by, providing an electrolyte temperature of at least approximately 940° C.; and operating the anode at a sufficiently low current density that reduction of alumina to produce aluminum and liberate oxygen is favored over a corrosion reaction of the anode by the cryolitic electrolyte.

8. The electrolytic process of claim 1 wherein the anode is constructed of a material which is not consumed in the electrolytic reduction reaction.

9. The electrolytic process of claim 1 further comprising:

monitoring the condition of the protective anode film by measuring change in voltage, current, or resistance between the anode and electrolyte to determine stability of the film.

10. The electrolytic process of claim 9 wherein monitoring the condition of the anode film comprises:

supplying a DC current to a sensor within the electrolyte, such current being less than a DC current supplied to the anode; and measuring a voltage drop over time between the anode and electrolyte using the sensor.

11. The electrolytic process of claim 10 wherein the sensor is constructed of the same material as the anode.

12. The electrolytic process of claim 9 wherein the film is maintained by varying current density.

13. The electrolytic process of claim 9 wherein the film is maintained by, providing an electrolyte temperature of at least approximately 940° C.; and operating the anode at a current density which favors the reduction of alumina to produce aluminum and liberate oxygen over corrosion of the anode by the cryolitic electrolyte.

14. The electrolytic process of claim 9 wherein the anode is constructed of a material which is not consumed in the electrolytic reduction of alumina to produce aluminum.

15. The electrolytic process of claim 9 wherein the operating parameters being controlled to maintain the film include at least anode current density and electrolyte temperature.

16. The electrolytic process of claim 15 wherein the operating parameters being controlled to maintain the film include at least $Al_2O_3$ concentration and electrolyte ratio.

* * * * *